US008136794B2

(12) United States Patent
Kempf

(10) Patent No.: US 8,136,794 B2
(45) **Date of Patent: *Mar. 20, 2012**

(54) TAB WINCH FOR STAGE USE

(75) Inventor: James Kempf, New Windsor, NY (US)

(73) Assignee: Vizio Inc., Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/053,496

(22) Filed: Mar. 22, 2011

(65) Prior Publication Data

US 2011/0163286 A1 Jul. 7, 2011

Related U.S. Application Data

(63) Continuation of application No. 12/483,890, filed on Jun. 12, 2009, now Pat. No. 7,909,307.

(60) Provisional application No. 61/061,403, filed on Jun. 13, 2008.

(51) Int. Cl.
*B66D 1/36* (2006.01)

(52) U.S. Cl. ..... 254/286; 254/281; 254/284; 254/285

(58) Field of Classification Search ..... 254/278, 254/280, 281, 284, 285, 286
See application file for complete search history.

(56) References Cited

U.S. PATENT DOCUMENTS

| | | | | |
|---|---|---|---|---|
| 4,438,903 | A | 3/1984 | Gagnon et al. | |
| 4,927,537 | A | 5/1990 | Meurer | |
| 4,928,927 | A | 5/1990 | Fredrick et al. | |
| 4,986,915 | A | 1/1991 | Meurer | |
| 5,257,891 | A * | 11/1993 | Baumann et al. | 414/460 |
| 5,423,438 | A * | 6/1995 | Swanson | 212/275 |
| 5,511,929 | A | 4/1996 | Loftus | |
| 5,678,805 | A | 10/1997 | Moser | |
| 5,860,786 | A * | 1/1999 | Aubrecht | 414/463 |
| 6,507,962 | B2 * | 1/2003 | Thurston | 5/10.1 |
| 7,025,334 | B2 | 4/2006 | Ehrenleitner | |
| 7,150,449 | B1 | 12/2006 | Dueck et al. | |
| 7,325,785 | B2 * | 2/2008 | Krengel et al. | 254/338 |
| 7,527,242 | B2 * | 5/2009 | Shaha | 254/286 |
| 7,614,608 | B1 | 11/2009 | Ebbenga | |
| 2005/0200191 | A1 | 9/2005 | Grier | |

* cited by examiner

*Primary Examiner* — Emmanuel M Marcelo
(74) *Attorney, Agent, or Firm* — Law Office of Scott C. Harris, Inc.

(57) ABSTRACT

A winch with adjustable arms allowing the length to be adjusted. The winch can have a very thin drum to allow it to fit in confined spaces.

17 Claims, 4 Drawing Sheets

TAB WINCH FOR STAGE USE

This application claims priority from provisional application No. 61/061,403, filed Jun. 13, 2008, the entire contents of which are herewith incorporated by reference. This is a continuation of application Ser. No. 12/483,890 filed Jun. 12, 2009, now U.S. Pat. No. 7,909,307.

BACKGROUND

Winches can be used to move various objects and scenery, especially in a stage lighting environment. In some applications for a winch, the distances over which force application are carried out can vary.

For example, when lifting scenery on a stage, the width of the scenery depends on the specific scenery being lifted. This width correspondingly sets the width over which the lifting needs to occur, e.g., when lifting is carried out by the two far sides.

Also, the supports for the lifting may be separated by varying widths.

SUMMARY

The present application describes a winch with movable end parts that allow it extend across variable length supports and to carry out lifting across those variable lengths.

DETAILED DESCRIPTION

According to an embodiment, a winch is described which can vary in width and hence can vary the locations of its outer extent.

Another embodiment describes special operations which enable a reduced-thickness winch. This can facilitate the use of this winch in certain applications, such as overhead and in limited space areas.

Figure 1A:
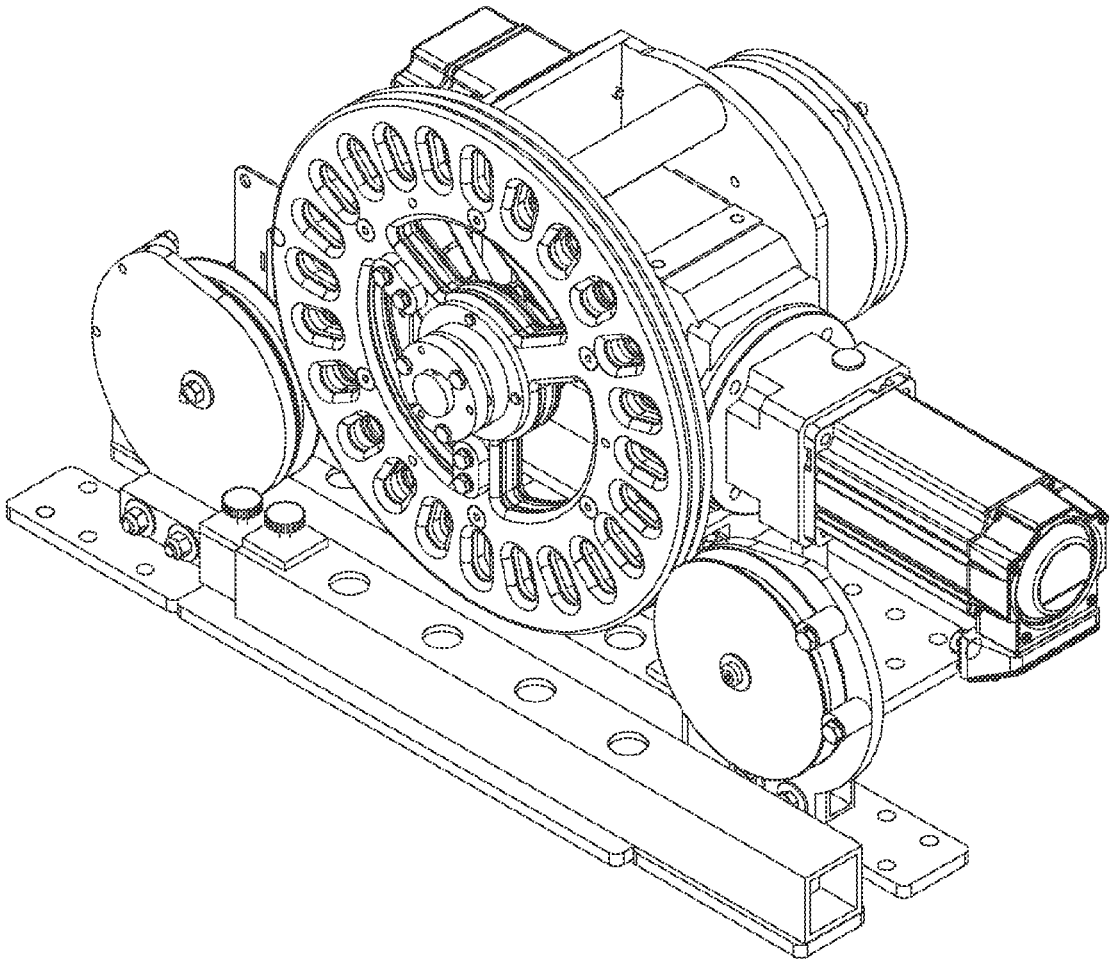
FIG. 1A-1C show the "tab" winch in multiple extended positions with different distances between the pulling areas.
Figure 1B:
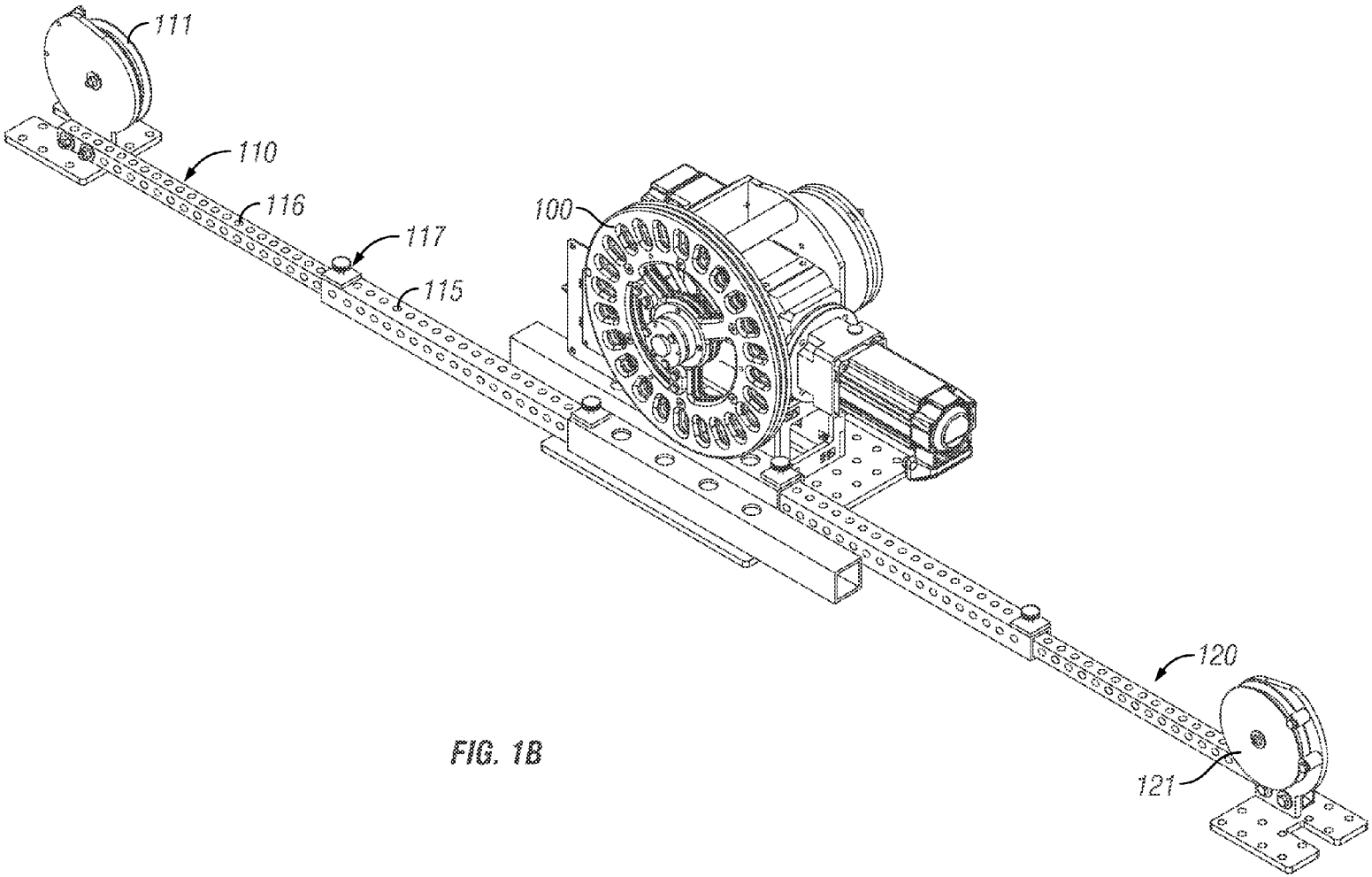
Figure 1C:
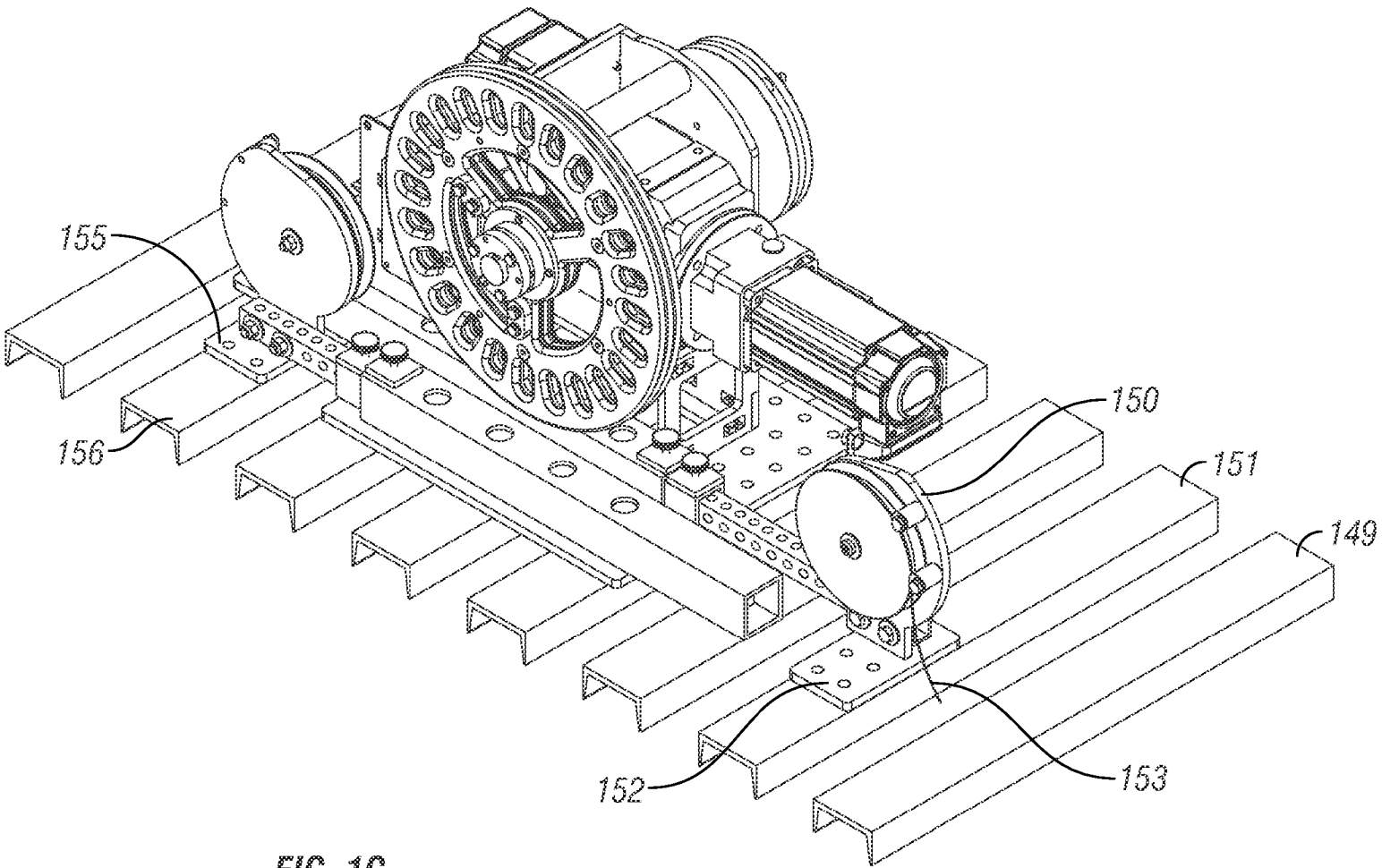

The basic diagram of the winch in multiple different configurations is shown in FIGS. 1A-1C.

The main part of the winch includes a special drum for unwinding cable from two different locations at the same time. The inventors call this a yoyo drum 100. The yoyo drum 100 has a power plant that causes its rotation. Two extendable arms 110, 120 are coupled to the yoyo drum 100 and can be extended relative thereto. Each arm 110, 120 has an idler at its very end. The arm 110 has the idler 111, and the arm 120 has the idler 121.

In operation, the cable pays onto and off of the drum 100 at two different locations simultaneously. One cable goes along arm 110 to idler 111, and is raised or lowered by the idler. The other cable goes along arm 120 to idler 121, and is simultaneously and synchronously raised or lowered from both spots.

Figure 2:
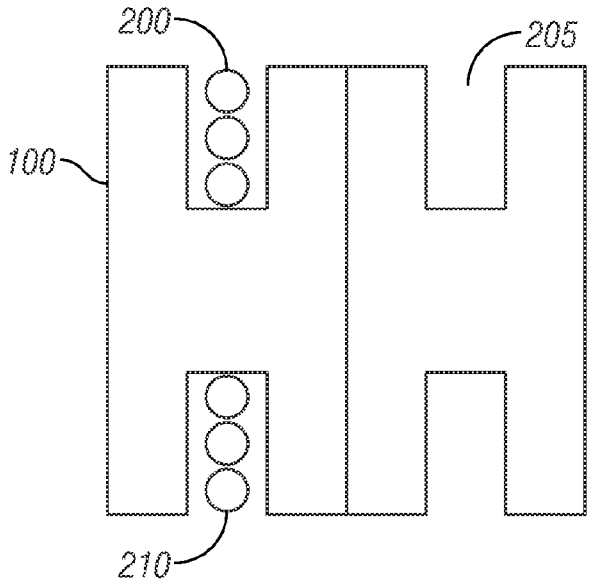
FIG. 2 illustrates a "tab" drum used according to an embodiment.

FIG. 2 shows a detail of the yoyo drum from its side, illustrating the two tabs in the drum and those tabs can each hold their own supply of cable. The yo-yo drum 100 includes two different tabs, 202 05. Each tab forms a slot that holds a stack of cable such as 210. The cable can be stacked in each slot up from one side of the driven element, while simultaneously fed or taken up on the other tab from the driven element.

The special design allows the yoyo drum to hold cable only within a "tab" in the drum, and hence allows the drum to be very thin, even though it is a double cable supply drum. In the embodiment, the drum can be about the same thickness as the arms that extend and retract, so that the drum can fit within whatever thickness the arms can fit in. In one embodiment the drum is no thicker than the arms. In another embodiment, the drum is no more than 1.5 times the thickness of the arm.

The embodiment enables reconfiguring between multiple different crossbar sizes. For example, the crossbar elements such as 110 includes two portions 115, 116, which slide relative to one another. The portion 116 is smaller in outer cross section than the portion 115, and hence the portion 116 fits within the portion 115. Fasteners such as screws and nuts 117 hold the portion 115 relative to the portion 116.

Other ways of holding the two arm parts together can also be used. For example, a clamp system could be used to hold the parts relative to each other. A threaded system could be used where one rod is threaded within the other.

Thus the lengths of the arms can each be independently adjusted to any desired length. Hence, this winch can be reconfigured between any desired set of crossbar lengths.

Figure 3:
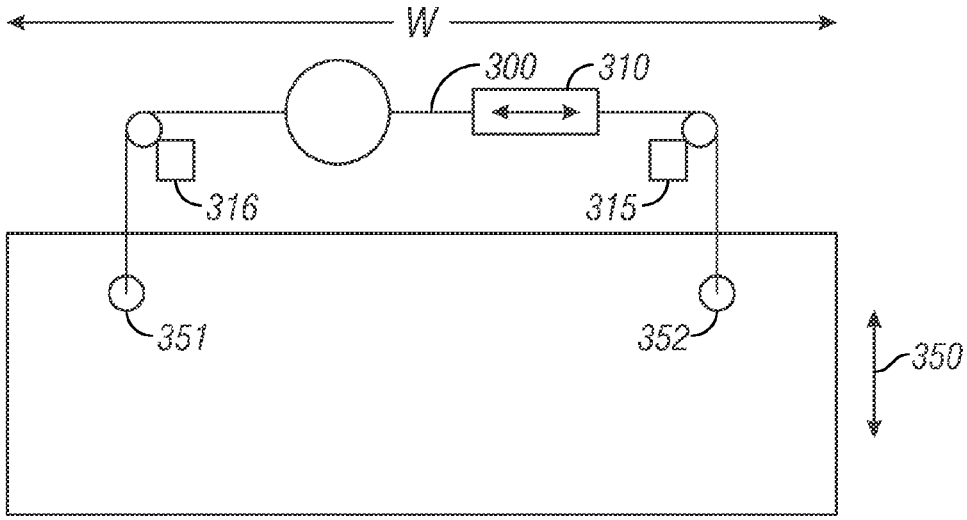
FIG. 3 illustrates the way that variable width lifting.

FIG. 3 illustrates how the distance 310 between the arms 315, 316 can be reconfigured. The distance W is based on the distance between holding portions 351, 352 on the item to be lifted 350. The movement of the winch cable causes the item 350 to go up and down.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art. For example, other sizes, materials and connections can be used. Other structures can be used to receive the magnetic field. In general, an electric field can be used in place of the magnetic field, as the primary coupling mechanism. Other kinds of antennas can be used. Also, the inventors intend that only those claims which use the-words "means for" are intended to be interpreted under 35 USC 112, sixth paragraph. Moreover, no limitations from the specification are intended to be read into any claims, unless those limitations are expressly included in the claims.

Where a specific numerical value is mentioned herein, it should be considered that the value may be increased or decreased by 20%, while still staying within the teachings of the present application, unless some different range is specifically mentioned. Where a specified logical sense is used, the opposite logical sense is also intended to be encompassed.

What is claimed is:

1. A winch device comprising:

a cable drum that releases and wraps first and second different supplies of cable simultaneously, said drum releasing and wrapping said first supply of cable in a first direction, and releasing and wrapping said second supply of cable in a second direction which is 180 degrees opposite from said first direction, where said first and second directions are both horizontal;

a first support arm with a first idler end, said first support arm coupled relative to said cable drum and said first idler end separated from said cable drum in said first direction, and said first support arm adjustable to extend in a horizontal direction to adjust a horizontal distance between said cable drum and said idler end in said first direction and said first idler arm receiving said first supply of cable in said first direction, and coupling said first supply of cable into a third direction which is 90 degrees separated from said first direction and which is vertical; and a second support arm, with a second idler end coupled to said second support arm, and said second idler end separated from said cable drum in said second direction, said second idler end receiving said second supply of cable in said second direction, and coupling said second supply of cable into said third direction which is 90 degrees separated from said first direction and which is vertical but horizontally spaced from said first supply of cable from said first idler end.

2. A winch as in claim 1, wherein said drum has two slots therein, each holding a separate supply of cable, and where said two slots rotate in sync with one another to wind and unwind said cable in sync.

3. A winch device as in claim 2, wherein said first and second support arms are held one relative to another in a first mode, and allowed to move in a second mode.

4. A winch as in claim 2, wherein said slots each hold only a single stack of cable with each roll of cable directly on top of another roll.

5. A winch as in claim 4, wherein said drum is no thicker than said first and second support arms.

6. A winch as in claim 5, wherein said drum is no more than 1.5 times thicker than said first and second support arms.

7. A winch device comprising:

a cable drum that releases and wraps first and second different supplies of cable simultaneously;

a first support arm with an idler end, said first support arm coupled relative to said cable drum and receiving said first supply of cable from said cable drum along a first axis;

a first arm moving part, that moves said first support arm relative to said cable drum along said first axis, such that said first idler end is moved closer to and farther from said cable drum along said first axis, and said idler end is lockable into a number of different positions at different distances relative to said cable drum;

a second support arm, with a second idler end coupled to said second support arm, said second idler end receiving said second supply of cable from said cable drum along said first axis; and a second arm moving part, that moves said second support arm relative to said cable drum along said first axis, such that said second idler end is moved closer to and farther from said cable drum along said first axis, and is lockable into a number of different positions at different distances relative to said cable drum.

8. A winch as in claim 7, wherein said cable drum releases and wraps said first and second different supplies of cable coaxially on said drum.

9. A winch as in claim 8, wherein said cable drum having a first maximum thickness, said first and second support drums having a second maximum thickness, and wherein said first maximum thickness is no greater than said second maximum thickness.

10. A winch as in claim 9, wherein said drum has two slots therein, each holding a separate supply of cable, and where said two slots rotate in sync with one another to wind and unwind said cable in sync.

11. A winch as in claim 10, wherein said slots each hold only a single stack of cable.

12. A method of winching comprising:

releasing a first different supply of cable simultaneously with releasing a second supply of cable, said first supply of cable being released in a first direction, said second supply of cable being released in a second direction which is 180 degrees opposite from said first direction, where said first and second directions are both horizontal;

first receiving said first supply of cable on an idler device that is separated from said cable drum in said first direction, and coupling said first supply of cable into a third direction which is 90 degrees separated from said first direction and which is vertical;

first extending a first support arm relative to a location of said releasing in a horizontal direction to adjust a horizontal distance between said cable drum and said idler device and said location of releasing;

second receiving said first supply of cable on a second idler device that is separated from said cable drum in said second direction, and coupling said first supply of cable into a fourth direction which is 90 degrees separated from said second direction and which is vertical;

second extending a second support arm relative to a location of said releasing in a horizontal direction to adjust a horizontal distance between said cable drum and said second idler device and said location of releasing.

13. A method as in claim 12, further comprising holding said locations of said first and second support arms in a first mode, and allowing said first and second support arms to move in a second mode.

14. A method as in claim 12, further comprising winding said supplies of cable into two slots in a single cable holding device where said two slots rotate in sync with one another to wind and unwind said cable in sync.

15. A method as in claim 14, wherein said slots each hold only a single stack of cable with each roll of cable directly on top of another roll.

16. A method as in claim 15, wherein said drum is no thicker than said first and second support arms.

17. A method as in claim 16, wherein said drum is no more than 1.5 times thicker than said first and second support arms.

* * * * *

UNITED STATES PATENT AND TRADEMARK OFFICE

CERTIFICATE OF CORRECTION

PATENT NO. : 8,136,794 B2
APPLICATION NO. : 13/053496
DATED : March 20, 2012
INVENTOR(S) : James Kempf It is certified that error appears in the above-identified patent and that said Letters Patent is hereby corrected as shown below:

Title Page, insert Item (73) Assignee:

--(73) Assignee: Production Resource Group, L.L.C., New Windsor, NY--.

Signed and Sealed this
Twelfth Day of February, 2013

Teresa Stanek Rea
*Acting Director of the United States Patent and Trademark Office*